US006164017A

United States Patent [19]

Burton

[11] Patent Number: 6,164,017

[45] Date of Patent: Dec. 26, 2000

[54] ADJUSTABLE LINKAGE

[75] Inventor: David J. Burton, Woodbury, Minn.

[73] Assignee: Sico Incorporated, Edina, Minn.

[21] Appl. No.: 09/226,365

[22] Filed: Jan. 6, 1999

[51] Int. Cl.[7] ..... E04H 3/28

[52] U.S. Cl. ..... 52/7; 52/69; 108/115; 248/188.6; 297/159.1

[58] Field of Search ..... 52/7, 69; 108/116, 108/115; 297/159.1; 248/188.6

[56] References Cited

U.S. PATENT DOCUMENTS

| | | |
|---|---|---|
| Re. 24,454 | 4/1958 | Wilson . |
| 89,306 | 4/1869 | Goodher . |
| D. 304,499 | 11/1989 | Rogers et al. . |
| D. 307,186 | 4/1990 | Rogers et al. . |
| 587,518 | 8/1897 | Bartelle . |
| 770,152 | 9/1904 | Bechtel . |
| 1,370,732 | 3/1921 | Corbett . |
| 1,614,539 | 1/1927 | Ryan . |
| 2,212,938 | 8/1940 | Hulscher . |
| 2,249,455 | 7/1941 | Caldwell . |
| 2,258,133 | 10/1941 | Chuma . |
| 2,278,817 | 4/1942 | Zeindler . |
| 2,368,748 | 2/1945 | Doty . |
| 2,508,627 | 5/1950 | Spiegel et al. . |
| 2,514,524 | 7/1950 | Steele . |
| 2,596,250 | 5/1952 | Klingler . |
| 2,621,095 | 12/1952 | Haumerson . |
| 2,645,539 | 7/1953 | Thompson . |
| 2,739,860 | 3/1956 | Wilson . |
| 2,747,958 | 5/1956 | Wilson . |
| 2,764,460 | 9/1956 | Nelson . |
| 2,766,089 | 10/1956 | Nielsen . |
| 2,771,937 | 11/1956 | Wilson . |
| 2,782,075 | 2/1957 | Fagan . |
| 2,831,741 | 4/1958 | Wilson . |
| 2,873,157 | 2/1959 | Wilson . |
| 2,887,348 | 5/1959 | Sadowsky . |
| 2,969,245 | 1/1961 | Wilson . |
| 2,977,169 | 3/1961 | Geller . |
| 2,978,754 | 4/1961 | Wilson . |

(List continued on next page.)

FOREIGN PATENT DOCUMENTS

| | | |
|---|---|---|
| 0 389 932 A1 | 10/1990 | European Pat. Off. . |
| 2 314 315 | 1/1977 | France . |
| 2 418 319 | 9/1979 | France . |
| 2 554 476 | 5/1985 | France . |
| 2 587 784 | 3/1987 | France . |
| 2 603 241 | 3/1988 | France . |
| 84 28 611 U | 2/1986 | Germany . |
| 2 318 273 | 4/1998 | United Kingdom . |
| WO 95/18901 | 7/1995 | WIPO . |
| WO 95/29311 | 11/1995 | WIPO . |

OTHER PUBLICATIONS

"Sico Staging & Risers . . . Leading the Way." 4 Page Brochure by Sico Incorporated.

*Primary Examiner*—Christopher T. Kent
*Attorney, Agent, or Firm*—Merchant & Gould P.C.

[57] ABSTRACT

A folding stage includes a spacing linkage that is adjustable. The spacing linkage locks the folding stage at its final use position. The linkage includes an adjustable link member having an adjustment device. The adjustment device provides for changing the length of the link. The adjustment device includes a housing having a block slidably mounted therein. The housing and the block both include transverse openings for receiving a pivot bolt. The end of the housing receives a bolt threadably connected to the sliding block. A nut on the exterior of the housing threadably connects to the bolt and positions the block relative to the end of the housing for adjusting the length of the link and the position of the spacing linkage.

15 Claims, 6 Drawing Sheets

U.S. PATENT DOCUMENTS 2,983,968 5/1961 Wurn .
2,993,740 7/1961 Good .
3,027,209 3/1962 Nielsen .
3,028,197 4/1962 Wilson .
3,034,843 5/1962 Moon .
3,075,809 1/1963 Wilson .
3,080,833 3/1963 Risdall .
3,099,480 7/1963 Wilson .
3,139,951 7/1964 Clayton .
3,143,982 8/1964 Blink et al. .
3,245,363 4/1966 Amthor, Jr. et al. .
3,276,401 10/1966 Wilson et al. .
3,337,262 8/1967 Katzfey et al. .
3,351,029 11/1967 Bue .
3,437,058 4/1969 Bue .
3,476,061 11/1969 Takahashi .
3,557,720 1/1971 Blink et al. .
3,799,073 3/1974 Nielsen .
3,861,325 1/1975 Bue et al. .
3,903,812 9/1975 Cowley .
3,999,491 12/1976 Wilson .
4,026,221 5/1977 Wilson et al. .
4,054,096 10/1977 Wilson et al. .
4,074,636 2/1978 Wilson .
4,104,835 8/1978 Bardwick, III .
4,133,271 1/1979 Carlson .
4,232,488 11/1980 Hanley .
4,327,650 5/1982 Bue .
4,570,751 2/1986 Kleu .
4,590,865 5/1986 Rütsche et al. .
4,615,279 10/1986 de la Haye .
4,627,364 12/1986 Klein et al. .
4,638,604 1/1987 Rogers et al. .
4,779,542 10/1988 Staten et al. .
4,779,878 10/1988 Betts et al. .
4,811,530 3/1989 Eyerly .
4,863,126 9/1989 Rogers et al. .
4,872,295 10/1989 Fujita .
4,917,217 4/1990 Rogers et al. .
4,934,113 6/1990 Hall et al. .
4,949,649 8/1990 Terres et al. .
4,979,340 12/1990 Wilson et al. .
4,995,679 2/1991 Segerljung .
5,050,353 9/1991 Rogers et al. .
5,317,842 6/1994 Rogers et al. .
5,323,563 6/1994 Rogers et al. .
5,325,640 7/1994 Luedke et al. .
5,367,963 11/1994 Jäggi et al. .
5,392,718 2/1995 Stevens .
5,615,451 4/1997 Peterson et al. .

ADJUSTABLE LINKAGE

BACKGROUND

1. Field of the Invention

The present invention is directed to a folding stage, and in particular, to a stage having an adjustable spacing linkage for locking and adjusting the position and alignment of the stage decks.

2. Prior Art

Folding stages are used for a variety of purposes to provide a temporary raised platform for use in schools, hotels, convention centers and other institutions or multiple use facilities requiring the capability of setting up temporary stages. Such stages may be positioned adjacent one another to form a stage surface or positioned to support bridging decks between the stages to form an extended stage surface. When not in use, the stages have a framework that folds to compact dimensions for better storage. Stages typically have two stage decks hinged together along a center line to provide folding action with legs that remain substantially vertical when the stage decks fold. An example of such a folding stage is shown in U.S. Pat. No. 5,325,640 to Luedke et al., issued Jul. 5, 1994, and assigned to Sico, Incorporated, the Assignee of the present invention. Although the Luedke et al. patent shows a useful and efficient folding stage, further improvements are still possible, particularly with locking and aligning folding stages.

A common problem that occurs with folding stages and that generally increases over time, is the adjustment of the stage to ensure that the decks remain substantially aligned and horizontal in the unfolded use position. Prior stages typically utilize a bolt at the center line of the stage that acts as a stop where the two deck frameworks come together along the folding center line. Adjustment of the stop adjusts the relative position of the frame and the decks. These types of stages also use a spacing linkage to apply tension to the stage in the use position to prevent accidental folding and to take up any looseness that would allow the stage to wobble or shift. As this linkage passes through a toggle position to a locked position, the decks are pulled to a slightly concave alignment before they revert back to level. At this point, the leveling bolt acts as a spring with an extremely high spring constant that must be compressed before it can return to the level position. Although this configuration prevents folding and does provide some alignment, it does not always provide adequate compression, forcing other portions of the linkage to have some play in order to allow the linkage to pass through the toggle position. Over time, the components may wear and/or loosen, changing alignment so that the bracing of the framework is less rigid and has even more play. This condition results in a stage feeling less stable in the unfolded use position.

A spacing linkage includes a stop to lock the stage at a desired use position. If the spacing linkage can be adjusted, the alignment of the decks may be maintained or realigned by changing the final stop position of the spacing linkage. As the final resting position of the spacing linkage is slightly below horizontal after passing through a toggle position so that the spacing linkage snaps into a locked position, the various links in the linkage and the relative positioning points provide choices for adjustment. As shown in FIG. 1, the vertical distance below horizontal may be adjusted or the length of the pivot links may be changed. The horizontal distance is generally fixed as the stage framework is typically fixed. As the three links form a right triangle and the length of the hypotenuse is governed by the formula: $A^2$ plus $B^2$ equals $C^2$ where A is the horizontal distance between the center point and the outer pivot position of the spacing linkage; B is the vertical distance below the horizontal at the stop position; and C is the length of the link. The adjustment of the link C changes at least one of the other factors. Since B is substantially constant, a smaller change in C will result in a greater change in A, governed by the formula A equals the square root of $(C^2-B^2)$, wherein $B^2$ is substantially constant. Therefore, a small adjustment in the distance of the link will provide a greater adjustment in the relative position of the vertical stop position of the spacing linkage and overall alignment of the stage. Although the relative vertical engagement for stopping the links may change the stop position, depending on the distance needed, an adjustable vertical member providing direct vertical adjustment at the center of the linkage may not be sufficient to correct misalignment in the stage.

It can be seen then that a new and improved folding stage is needed that overcomes the problems with the prior art. An improved folding stage should provide a locking and spacing mechanism that can be easily adjusted that does not cause the components to loosen and lead to wobbling and a less stable stage. The spacing linkage should provide sufficient adjustability to provide proper alignment of the stage decks in the use position. The present invention addresses these as well as other problems associated with spacing linkages.

SUMMARY

The present invention is directed to a folding stage having a spacing linkage that is adjustable.

An elevationally adjustable folding stage includes a pair of decks that form a horizontal stage surface and a supporting framework and legs. The stage folds along a center line from a use position wherein the decks are horizontal to a storage position wherein the undersides of the deck substantially oppose one another. The folding is facilitated by a folding linkage providing folding along the center line and maintaining the legs in a substantially vertical position. The stage is locked in its use position by a locking or spacing linkage extending between opposed legs.

The spacing linkage passes through a toggle point to a stop position with the links extending slightly below horizontal. The weight and balance of the stage tends to push the links further below horizontal. However, a tab from one link extends over and engages the top of another link so that the linkage acts as a stop, maintaining the stage in a folded position. If adjustment may be needed, it is necessary to change the position of the linkage and therefore, the final stop position of the stage. To provide adjustment, one of the links provides for adjusting its overall length, thereby changing the final stop position of the stop linkage. The adjustable link includes an adjustment device at one end. The adjustment device includes a retainer housing with a block slidably mounted therein. The block includes a bore formed transversely therethrough that is aligned with a longitudinal opening in the sides of the retainer portion and receives a pivot pin. The block is maintained in a position by a bolt extending out the end of the retainer portion. The bolt is threadably retained in the sliding block. A first nut and second nut are positioned on the bolt outside of the retainer portion and tightened against the end of the retainer portion to position the bolt, and therefor the pivot point. Since the linkage is under tension, it is not necessary to provide positioning of the sliding block with regard to the opposite direction. The first nut acts as a positioning member relative to the retainer portion while the second nut acts as a lock on the first nut. With this configuration, accidental changes in the position of the bolt are not possible. The adjustment of the length of the spacing linkage link provides a greater change in distance in the vertical position of the linkage and therefor, in the vertical position of the center of the stage in the use position. Therefore, minor adjustments in the stage translate into greater adjustments in the relative position of the decks so that alignment can be maintained.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
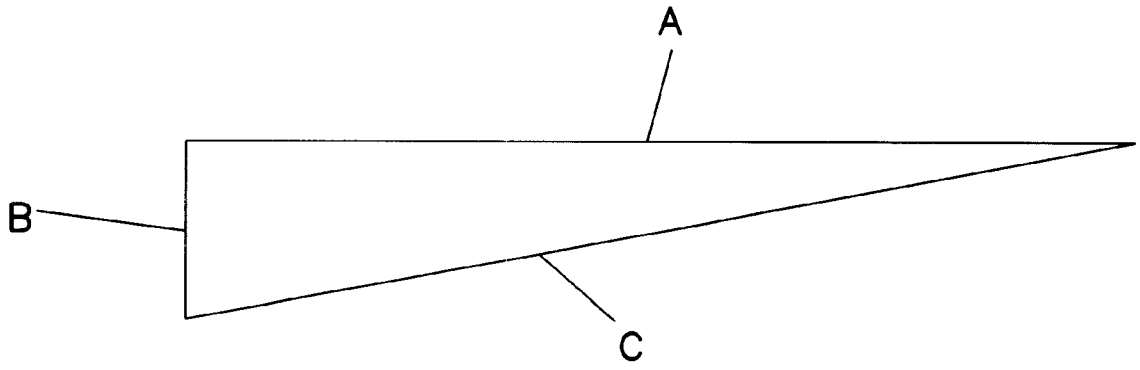
FIG. 1 shows a diagram of the relationship between the link and vertical and horizontal distances in a spacing linkage.
Figure 2:
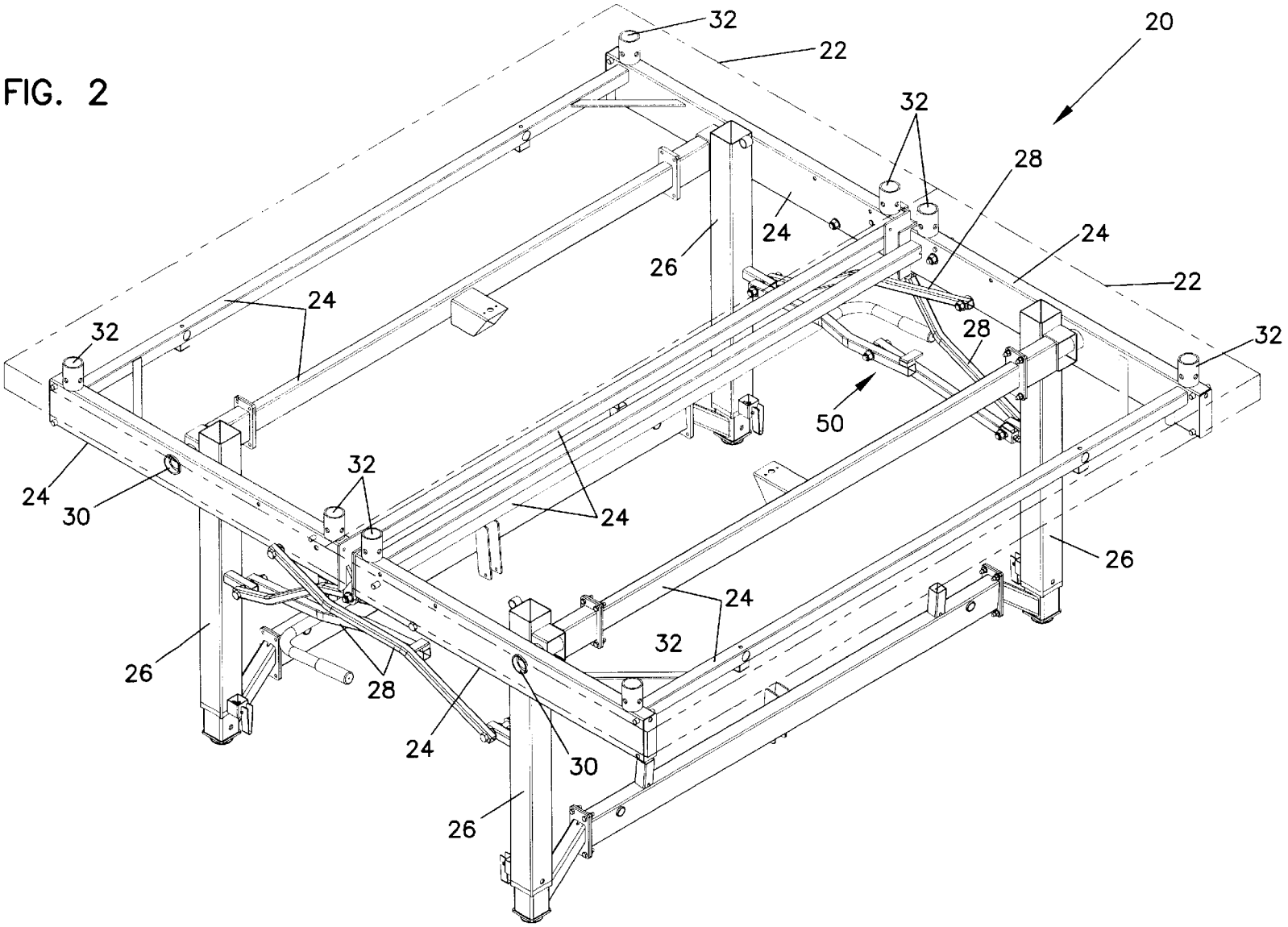
FIG. 2 shows a perspective view of a folding stage with an adjustable spacing linkage according to the principles of the present invention.
Figure 3:
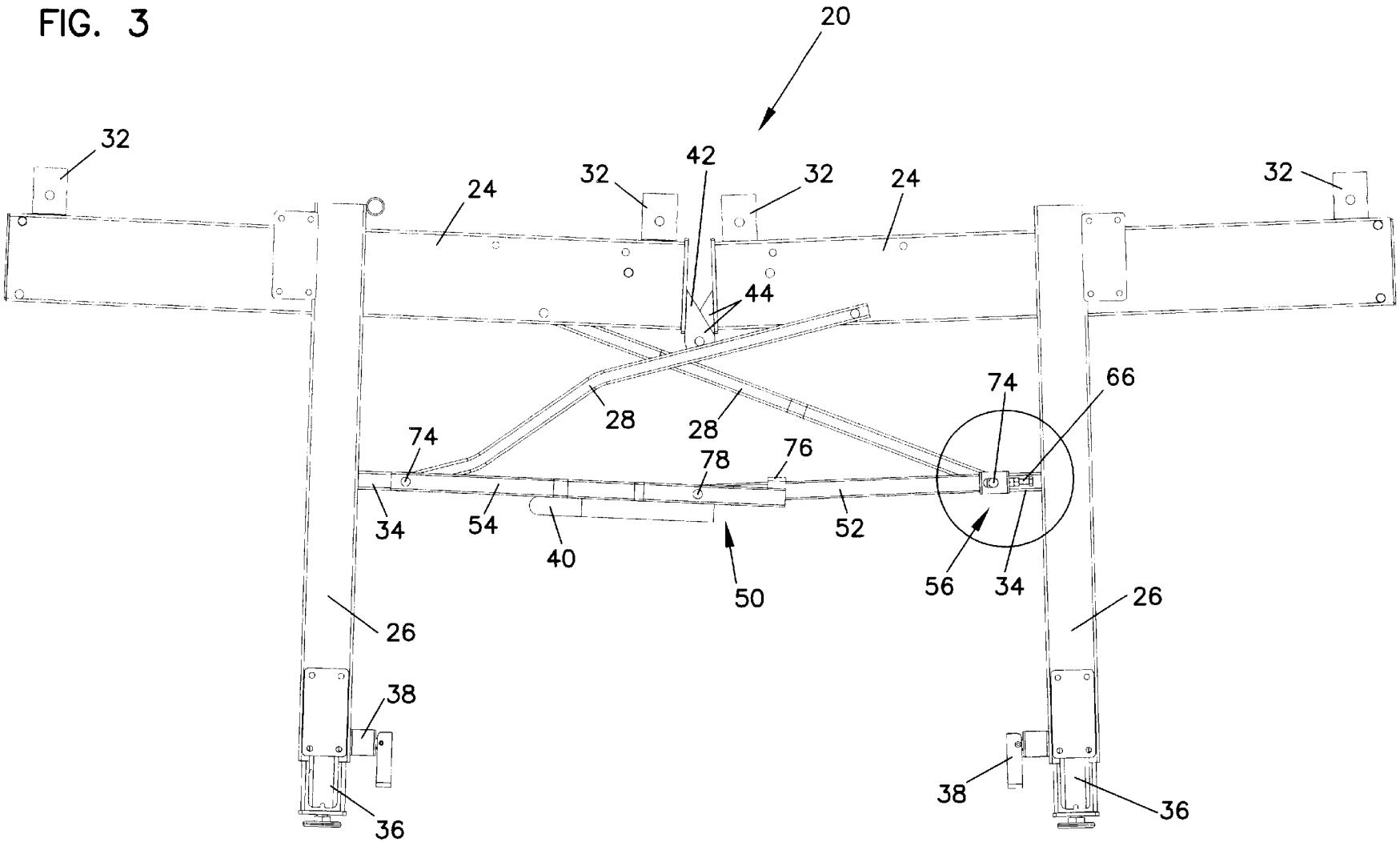
FIG. 3 shows a front elevational view of the folding stage shown in FIG. 2.
Figure 5:
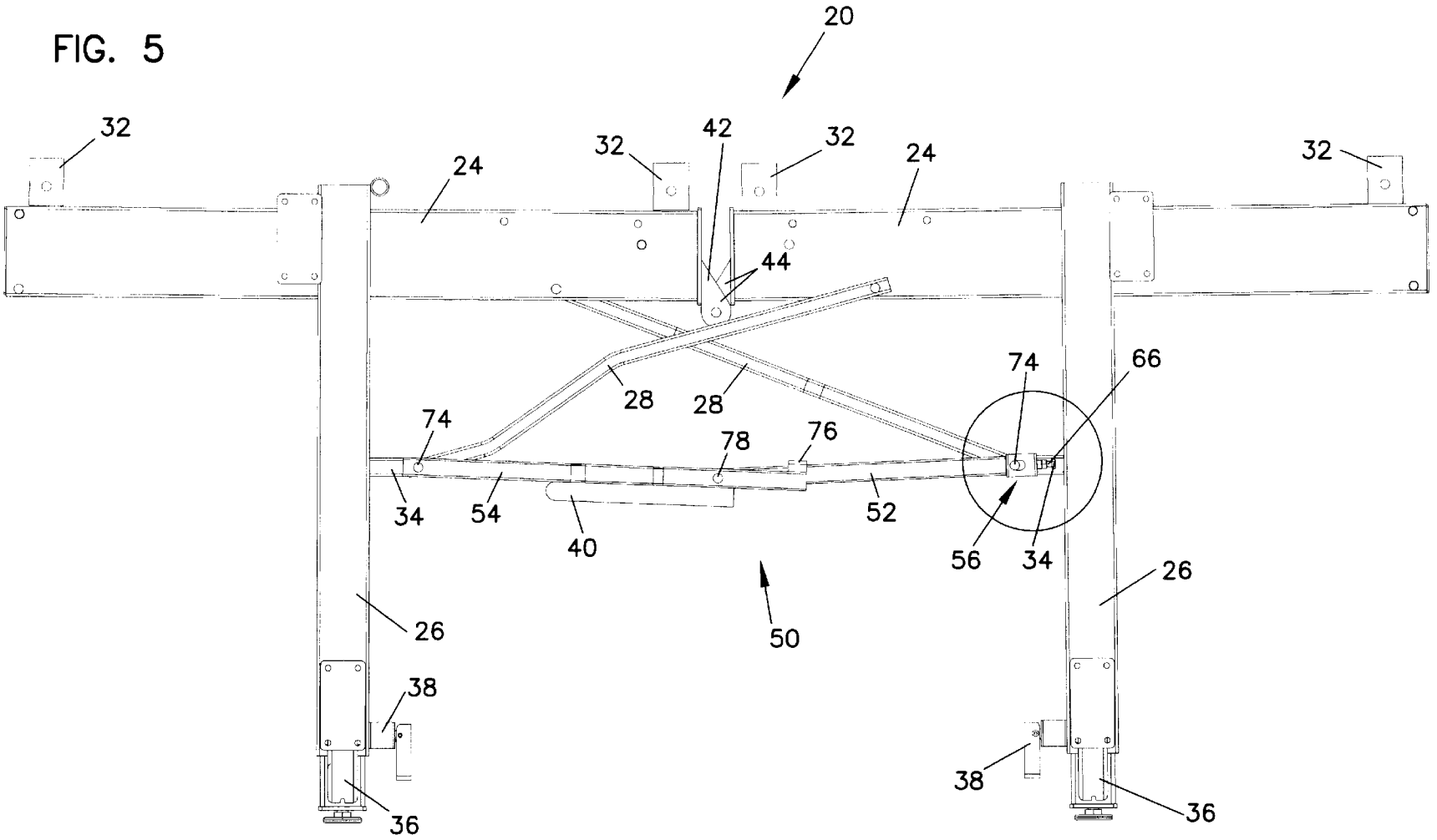
FIG. 5 shows a front elevational view of the stage shown in FIG. 2 with the spacing linkage adjusted.

Referring now to the drawings, and in particular to FIG. 2, there is shown an elevationally adjustable folding stage, generally designated 20. The folding stage 20 includes a pair of stage decks 22 that form an extended stage surface in the use position as shown, and fold so that the undersides of the decks substantially oppose one another in the folded storage position. The decks 22 are supported on a folding frame 24 and legs 26. The frame 24 folds with a linkage 28 extending between the opposed portions of the frame 24 to create a center line substantially aligned below the intersection of the decks 22. Center links 42 and 44 shown in FIGS. 3 and 5, provide pivoting along the center axis between the use and storage positions. The frame 24 folds about the legs 26 substantially at pivot points 30 and may include torsion bars (not shown) to aid in guiding the stage 20 during folding and unfolding. The lower links of the linkage 28 connect to the frame 30 through linkage mounts 34. The legs 26 include telescoping portions 36 that provide for elevational adjustment set with adjustment pins 38. An actuator handle 40 provides for folding the linkage 28 between the use and storage positions.

A locking or spacing linkage 50 provides a stop point for the folding stage 20 so that the decks 22 are maintained with a substantially planar horizontal upper surface in the use position. The spacing linkage 50 also serves as a lock to maintain the stage 20 in the unfolded use position. As the various portions of the frame 24 and linkage 28 have some play and may require adjustment over time, it may be necessary to provide adjustment to the stage 20. As shown in FIG. 3, the spacing linkage 50 passes through a toggle point and its links 52 and 54 are actually directed slightly below horizontal in the use position. It can be appreciated that the frame 24 supports the decks 22 so that they angle slightly downward towards the center line. This results in an uneven upper stage surface. To provide a planar horizontal stage surface, it is preferred that the stage 20 be adjusted accordingly, such as to an improved position similar to that shown in FIG. 5. The alignment is improved by approximately three degrees from the position shown in FIG. 3 to the position shown in FIG. 5.

Referring again to FIGS. 2 and 3, the spacing linkage 50 includes an adjustable link 52 mounting to a second link 54 at a center pin 78. The adjustable link 52 includes an adjustment mechanism 56 for varying the length of the adjustment link in the position of the spacing linkage 50. At the stop position shown in FIGS. 2, 3 and 5, a locking tab 76 on the second link 54 extends over and engages the top of the adjustable link 52 and stops further pivoting of the spacing linkage 50. In the stop position, the spacing linkage 50 has passed through a toggle point at horizontal and is held in position by the weight of the stage 20 tending to push the spacing linkage 50 further downward, but the locking tab 76 stops further movement. The adjustment link 52 mounts to the center pivot pin 78 and the second link 54 at one end and at the adjustment mechanism 56 to a pivot pin 74 on the other end.

Figure 7:
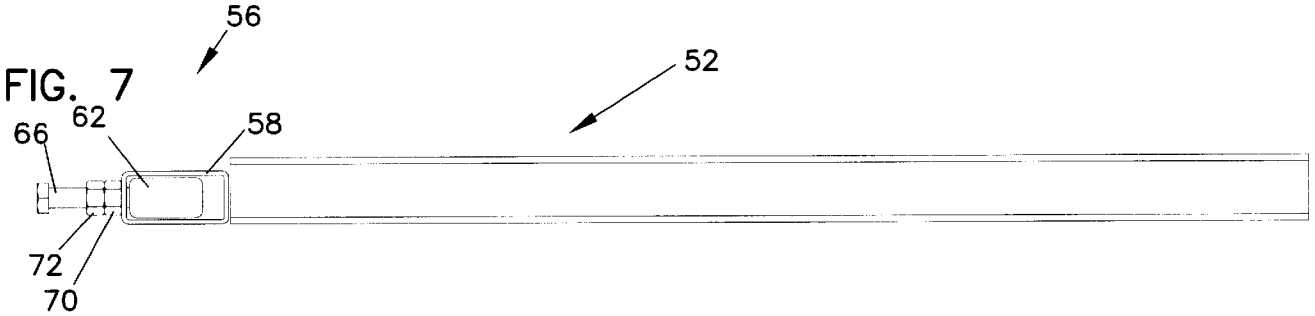
FIG. 7 shows a top plan view of a link having an adjustment portion for the spacing linkage of the stage shown in FIG. 2.
Figure 8:
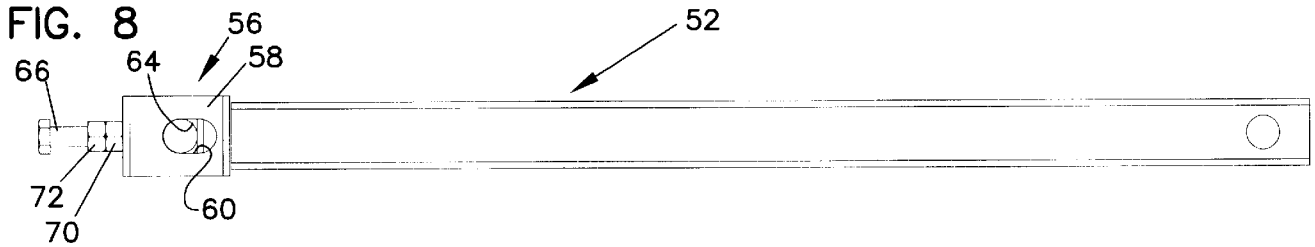
FIG. 8 shows a side elevational view of the link shown in FIG. 7.
Figure 9:
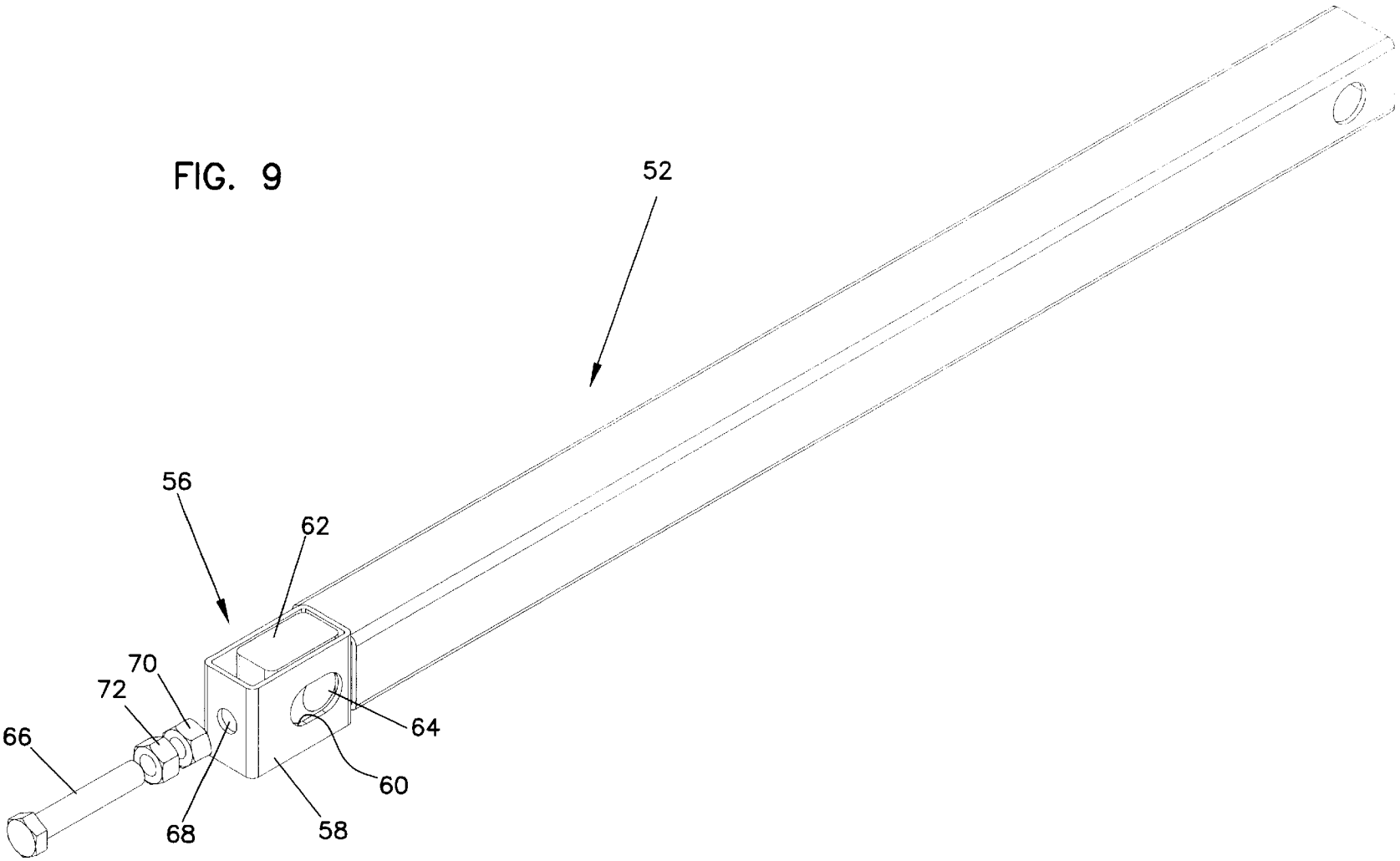
FIG. 9 shows a partially exploded view of the link shown in FIG. 7.

Referring now to FIGS. 7–9, the adjustment mechanism 56 includes a housing type retainer portion 58 having an open top and bottom, the retainer portion 58 also has side portions with a longitudinal oval opening 60 formed therein for receiving the pivot pin 74. A pivot block 62 is slidably retained within the retainer portion 58. The sliding pivot block 62 includes a bore 64 extending transversely therethrough and aligned with the oval opening 60 for receiving the pivot pin 74. As the pivot block 62 can be moved longitudinally within the retainer portion 58, the pivot pin 74 must be allowed to move with the pivot block 62 to adjust the effective length of the adjustable link 52. Therefore, the opening 60 is elongated to provide for adjustment of the pivot point extending through the pin 74. Even though the retainer portion 58 does not move back and forth, the effective length of the link 52 is changed as the distance between the two pivot points at pins 74 and 78 can be varied. The sliding block 62 is held in position at its end by a bolt 66 threadably connecting therein through corresponding internal threads in the end of the sliding pivot block 62. The bolt 66 extends through an end hole 68 in the retainer portion 58. First and second nuts 70 and 72 provide for holding the desired portion of the bolt 66 extending outward from the retainer portion 58. A first nut 70 engages the end of the retainer portion 58 while the second nut 72 acts as a lock on the first nut 70 to prevent rotation and further misalignment. As the stage 20 needs further adjustment for initial setup or due to misalignment, the sliding block 62 may be adjusted to change the length of the adjustable link 52 and therefore the position of the spacing linkage 50. Adjustment is easily made by loosening the nuts 70 and 72 and inserting or retracting the bolt 66 the desired distance relative to the retainer to obtain the proper position.

Figure 6:
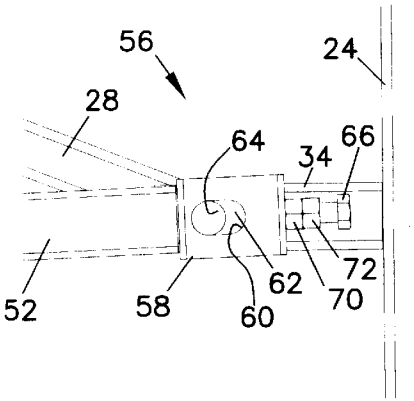
FIG. 6 shows a detail view of the adjustment portion for the spacing linkage in the position shown in FIG. 5.
Figure 4:
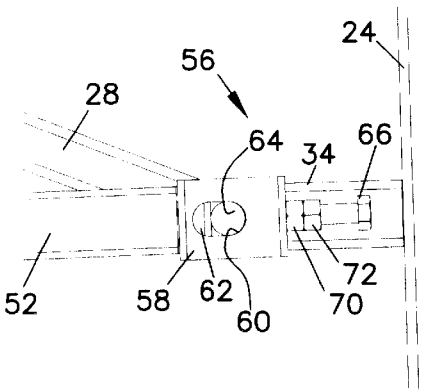
FIG. 4 shows a detail view of an adjustment portion of a link for the spacing linkage shown in FIG. 2.

Referring to FIGS. 3 and 4, the stage is shown with a slight inward tilt. The legs 26 tilt toward one another so that a horizontal stage surface is not achieved. Referring to FIG. 4, the pivot pin 74 is at the extreme far outward end of the opening 60 and the retainer portion 58. To adjust the linkage 50, the adjustable link 52 should be shortened. Therefore, the bolt 66 is loosened and the pivot block 62, and therefor the pin 74 is moved inward to the position shown in FIG. 6. At this position, the adjustable link 52 has decreased length and the position of the spacing linkage 50 is brought further upward, thereby moving the stage 20 to better alignment with the legs 26 extending substantially vertically.

A minor change in the length of the adjustable link 52 changes the overall distance the center pin 78 of the spacing linkage 50 is below the horizontal line extending through the pivot pin 74. This provides a corresponding change in the vertical distance at the center line of the frame 24 and the decks 22. Greater adjustments can be compensated by only minor changes in the length of the adjustable link 52.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A link comprising:

an elongate member having a first end with a retainer portion;

a pivot member slidably mounted in the retainer portion;

a positioning member connected to the pivot member and adjustably mounted to the elongate member, wherein moving the positioning member changes the position of the pivot member relative to the elongate member.

2. A link according to claim 1, wherein the positioning member mounts on the end of the elongate member.

3. A link according to claim 1, wherein the pivot member is adapted for pivotally connecting to other links.

4. A link according to claim 1, wherein the positioning member comprises a bolt threadably connected to the pivot member.

5. A link according to claim 4, further comprising a first nut and a second nut mounted to the bolt, wherein the first nut engages an end of the retainer portion.

6. A link according to claim 1, wherein the pivot member includes a bore formed therethrough.

7. A link according to claim 6, wherein the retainer portion includes an opening aligned with the bore of the pivot member.

8. A link according to claim 7, wherein the opening in the retainer portion is elongate extending longitudinally with the link.

9. A link according to claim 1, wherein the positioning member comprises a bolt with a nut mounted thereon, wherein the nut engages the retainer portion and wherein adjusting the position of the nut on the bolt changes the position of the pivot member relative to the elongate member.

10. A link according to claim 9, wherein the bolt extends longitudinally from the first end of the elongate member.

11. A linkage comprising:

a first link member having a first end with a retainer portion;

a pivot member slidably mounted in the retainer portion;

a positioning member connected to the pivot member and adjustably mounted to the first link member, wherein moving the positioning member changes the position of the pivot member relative to the first link member;

a second link member pivotally connected to the pivot member.

12. A linkage according to claim 11, wherein the positioning member comprises a bolt with a nut mounted thereon, wherein the nut engages the retainer portion and wherein adjusting the position of the nut on the bolt changes the relative position of the pivot member relative to the first link.

13. A linkage according to claim 12, wherein the bolt extends longitudinally from the first end of the first link member.

14. A folding stage, comprising:

opposed decks forming a horizontal stage surface in a use position and having undersides substantially opposing one another in a storage position;

a folding frame folding the stage between the use position and the storage position;

a spacing linkage connecting to the frame and forming a stop for the spacing linkage at the use position, the spacing linkage including a first link member having a first end with a retainer portion, a pivot member slidably mounted to the retainer portion, a positioning member connected to the pivot member and adjustable mounted to the first link member, wherein moving the positioning member changes the position of the pivot member relative to the first link member, and a second link member pivotally connected to the pivot member.

15. A linkage comprising:

an adjustable length first link, the first link having an end housing, a pivot member slidably mounted in the housing, an adjusting bolt mounted to the end of the first link housing and threadably connected to the pivot member, a spacing nut mounted to the bolt beyond the extended end of the housing, wherein axial adjustment of the spacing nut moves the pivot member longitudinally relative to the first link.

* * * * *